US005501646A

United States Patent [19]

Miller

[11] Patent Number: 5,501,646

[45] Date of Patent: Mar. 26, 1996

[54] JAW, FACE AND NECK MUSCLE EXERCISE APPARATUS

[75] Inventor: Warren G. Miller, Linthicum, Md.

[73] Assignee: W. G. Miller Associates, Linthicum, Md.

[21] Appl. No.: 296,477

[22] Filed: Aug. 26, 1994

[51] Int. Cl.[6] ..... A63B 23/025; A63B 23/03

[52] U.S. Cl. ..... 482/11; 482/112; 482/128; 482/10

[58] Field of Search ..... 482/10, 11, 111, 482/112, 124, 128

[56] References Cited

U.S. PATENT DOCUMENTS

| | | | |
|---|---|---|---|
| 1,466,559 | 8/1923 | Purdy . | |
| 1,851,865 | 3/1932 | Ptacek . | |
| 1,953,088 | 4/1934 | Purdy . | |
| 2,791,999 | 5/1957 | Bostamante | 482/10 |
| 3,497,217 | 2/1970 | Feather . | |
| 3,721,439 | 3/1973 | Rudolph et al. . | |
| 3,736,925 | 6/1973 | Erman . | |
| 3,813,096 | 5/1974 | Weich . | |
| 4,066,259 | 1/1978 | Brentham | 482/112 |
| 4,195,833 | 4/1980 | Svendsen . | |
| 4,280,696 | 7/1981 | Ramon . | |
| 4,650,182 | 3/1987 | Ross . | |
| 4,744,556 | 3/1988 | Shaffer . | |
| 4,834,366 | 5/1989 | Hotchkiss | 482/128 |
| 4,909,502 | 3/1990 | Beeuwkes, II et al. . | |
| 4,955,367 | 9/1990 | Homsy . | |

OTHER PUBLICATIONS

"Take the Click Out of This Joint." Prevention. p. 84, May 1994.

*Primary Examiner*—Lynne A. Reichard
*Attorney, Agent, or Firm*—Browdy and Neimark

[57] ABSTRACT

A jaw and neck muscle exercise apparatus which includes a spring loaded support arm attached to a soft chin support on one end and to a chest plate on the other end. The chest plate is strapped around the chest bone/collar bone area and the back of the neck by a collar strap. The lower jaw may then be exercised by opening the mouth or lowering the entire head against the resistance of the spring. The resistance is selected to be proper for the size and strength of the user and the progress of the exercise program to date. Proper use of this device will cause the muscles of the face, chin and neck to become toned and conditioned, eliminating fatness below the chin and wrinkles, particularly exercising the hyoid, the infrahyoid and digastric muscles.

7 Claims, 3 Drawing Sheets

JAW, FACE AND NECK MUSCLE EXERCISE APPARATUS

FIELD OF THE INVENTION

The present invention relates in general to muscle exerciser apparatus and, more particularly, to jaw and neck muscle exerciser apparatus in which a spring mechanism is applied below the chin to provide an upward compressive resistive force against the opening of the lower jaw or the downward movement of the head such that the muscles of the lower jaw and the neck may be exercised by countering such upward force.

BACKGROUND OF THE INVENTION

It is well known that lack of consistent use of muscles tends to make them weak and flabby, and these conditions are particularly objectionable and noticeable where those muscles are exposed to view, as is the case of the face, chin and neck of human beings. In early life, the strenuous activities of childhood call into play and develop such musculature, but with advancing age, and more sedentary occupations, there are fewer occasions for use of such muscles, and their tone and appearance may deteriorate markedly. The facial skin tends to droop and become flabby with the development of wrinkles in the skin and hollowness in certain facial regions. Many persons desire to retain or restore the firmness and evenness of the facial contour wrinkled and droopy facial skin. Since the skin is not adapted to support the underlying muscles, this creates an even stronger tendency for the skin to droop and wrinkle. During a surgical face lift the facial muscles are practically untouched. Consequently, the surgical face lift provides a temporarily tightened facial skin with the appearance of a lift of the facial contour; however, it also starts the process of drooping and wrinkling over again.

It is understood that the contour of the face is determined by the condition of the muscles beneath the skin. In the head and face of every typical human being, there is a group of 56 separate muscles. Of all the muscles in the body, the jaw muscle is the most powerful. Yet, the only time this muscle is used and hence is taxed is when one chews, smiles, grimaces and talks. When the muscles underlying the facial skin are strong and have good tone the skin is tight and smooth and the face has a youthful appearance. However, as the facial muscles lose tone, by reason of aging or lack of proper exercise, the muscles elongate and droop or sag. This results in a change of facial contour with attendant wrinkles in the skin and the formation of the ubiquitous "double chin".

The main muscle between the Adams apple and the chin, the digastric muscle, is very rarely used. Because of its almost total disuse, the muscles in that part of the face are not practically taxed and they therefore become flabby and loose. For every muscle in the body, including those in the face, there is an opposing muscle or group of muscles. When persons open their mouths to speak or to take in nourishment, practically no effort is required on the part of the digastric muscle as the mouth can fall open under the force of gravity.

The temporomandibular joint, located in front of each ear, and various temporomandibular dysfunctions are commonly referred to as TMJ. The temporomandibular joint serves as a hinge for the lower jaw. The temporomandibular joint may become misaligned because of aging, arthritis, a blow to the jaw or head or yawning for prolonged periods with the mouth open too wide. Among the more common temporomandibular joint dysfunction symptoms are: earaches, tinitis (ringing, tinkling, hissing), clicking (Articular Crepitus), difficulty in opening the mouth (trismus), headaches (particularly in the infraemporal region) and vertigo.

Dentists often concentrate on reducing painful muscle spasm through heat, massage, and drugs that relax the muscles and kill pain which may temporarily reduce these symptoms. Treatment may also include use of a bite plate, which is an individually fitted acrylic mouthpiece that slips on the lower or upper teeth to reposition the jaw or redistribute stress. More complex treatment may be directed to corrected malocclusion by causing the upper and lower jaws to mesh again. Occlusal restoration involves restoring bad teeth and replacing missing ones. This is often sufficient to relieve the pain and discomfort of mild TMJ dysfunctions. More involved TMJ dysfunctions may require equilibration or balancing the jaws by grinding away high spots and filling in low spots on the teeth, allowing the jaw muscles to relax.

Another technique comprises relaxation training assisted by biofeedback that frequently yields the greatest results in relieving facial pains stemming from night-time tooth grinding.

An article in *PREVENTION* magazine ("Take the Click Out of This Joint", *PREVENTION,* pg. 84, May 1994) discusses exercises to relieve temporomandibular joint disorders. The exercise suggested includes moving the jaw to the left and right for 5 mm to each side and opening and closing the jaw for 15 mm against a slight hand resistance with the hand supporting the chin and the elbow on a fixed surface, such as a table. Such exercises have been shown to make some TMJ problems gradually abate.

Various devices have been devised to strengthen or improve neck, facial or oral muscles through exercise. Generally, these comprise means of compression. The following U.S. patents show various means for exercising specific head, oral or facial muscles: U.S. Pat. Nos. 1,466,559; 1,851,865; 1,953,088; 3,497,217; 3,721,439; 3,736,925; 3,813,096; 4,195,833; 4,280,696; 4,650,182; 4,744,556; 4,909,502; and 4,955,367. See also copending application Ser. No. 08/104,893 of the present inventor.

U.S. Pat. No. 4,650,182, to Ross, is designed particularly for the exercise of the jaw, specifically designed to exercise the muscles of mastication and their auxiliaries, such as for the relief of TMJ and/or myofacial pain symptoms. A headband is connected to a chin strap by flexible strips. One moves or opens his/her jaw against the elastic resistance force of the elastic resistance coupling members, thus strengthening the muscles of mastication and auxiliaries. However, this device cannot be used to simultaneously exercise the muscles of the neck.

U.S. Pat. No. 3,497,217, to Feather, relates to a spring-type neck and facial exerciser having a base plate adapted to rest upon the infraclavicular region of the thorax with a chin engaging plate spaced above the base plate. A hinge connects the posterior portions of the base plate and chin plate with springs disposed between the members for resisting compression by a depression of the chin of the user. This rather clumsy device is used only as a neck conditioner and not for toning and conditioning the muscles of the area of the face between the Adam's apple and the neck. Further, it does not recognize the value of providing a variable resistance. Because of the way it is arranged, the chin will slide on the chin plate and it will not be particularly comfortable in use.

SUMMARY OF THE INVENTION

Accordingly, it is an object of the present invention to resolve the deficiencies of the prior art.

It is another object of the present invention to provide an exercise device which will allow the proper conditioning and toning of the muscles of the jaw and the neck.

It is a further object of the present invention to provide a device which will create upward compressive force against the lower jaw, against which the jaw can be exercised in a number of directions.

It is yet another object of the present invention to provide a device in which the compressive force applied against the opening of the jaw or the lowering of the chin is variable.

These and other objects of the present invention are accomplished by means of the present device which includes a spring loaded support arm attached to a soft chin support on one end and to a breast plate on the other end. The breast plate is strapped around the chest bone/collar bone area and the back of the neck by a collar strap. The lower jaw may then be exercised by opening the mouth or lowering the entire head against the resistance of the spring. The resistance is selected to be proper for the size and strength of the user and the progress of the exercise program to date. Proper use of this device will cause the muscles in the face, chin and neck to become toned and conditioned, eliminating fatness below the chin and wrinkles, particular exercising the hyoid, infrahyoid and digastric muscles.

DETAILED DESCRIPTION OF THE PREFERRED EMBODIMENTS

Figure 1:
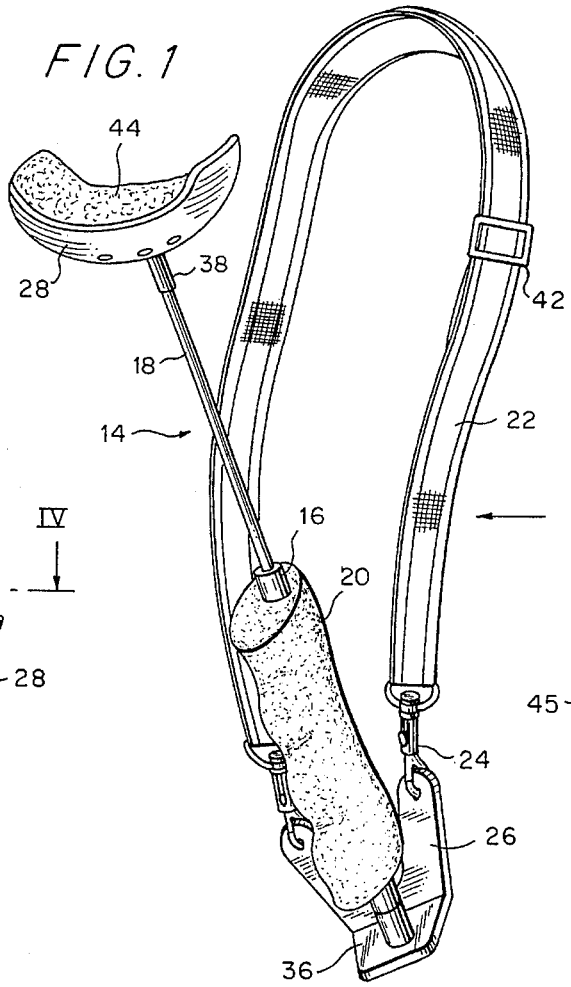
FIG. 1 is a perspective view of one embodiment of the jaw and neck muscle exercise device of the present invention.

The jaw and muscle exercise apparatus 14 in accordance with the present invention includes a piston rod 18 connected at one end to a chin cup 28 and extending at the other end into a spring mechanism 16. The end of the spring mechanism 16 opposite the end from which the piston 18 extends is connected to a chest plate 46 by a fastening device such as bolt 40. The chest plate 46 includes a surface 26 adapted to rest against the chest of the user when in use and a plate 36 to which the spring device 16 is connected. Plate 26 and 36 are disposed substantially perpendicular to one another. The plates 26 and 36 of chest plates 46 are preferably formed from a single piece of metal which is bent into a substantially L-shape, as shown, for example, in FIG. 10.

Figure 2:
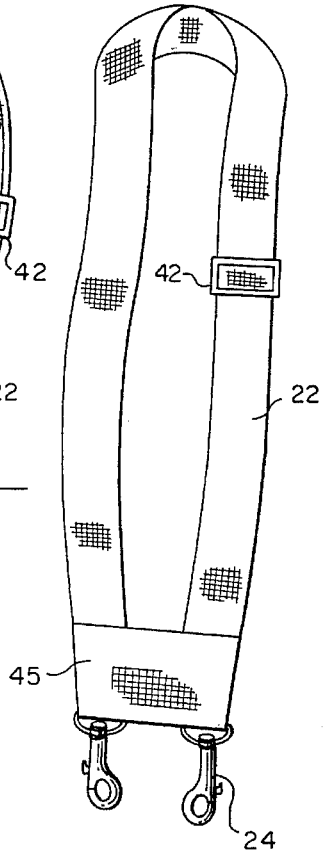
FIG. 2 is a front view of the collar strap which may be used in accordance with the present invention.

The chest plate 46 is connected by means of clips 24 to a collar strap 22, which preferably has an adjustable length which may be adjusted by means of buckle 42. The ends of the collar strap 22 may optionally be sewed together such as is shown at 45 in FIG. 2.

The outside of the spring cylinder 16 is preferably surrounded by a handle 20 made, for example, of appropriate plastic or rubber material.

Figure 4:
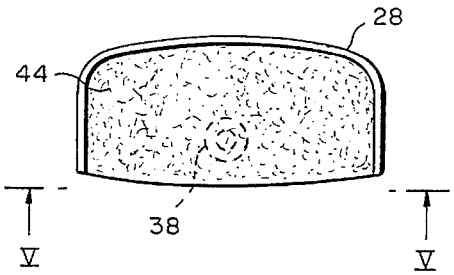
FIG. 4 is a top view of the chin-support shown along lines IV—IV of FIG. 3.
Figure 5:
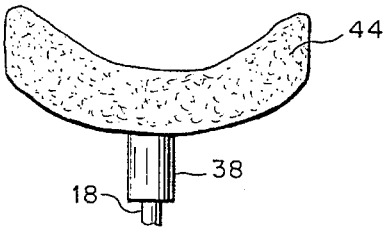
FIG. 5 is a side view of the chin support shown along lines V—V of FIG. 4.

As shown in FIGS. 4 and 5, the chin cup 28 preferably includes a soft inner surface 44 such as a foam rubber material in order to provide comfort to the chin of the user when in use.

Figure 3:
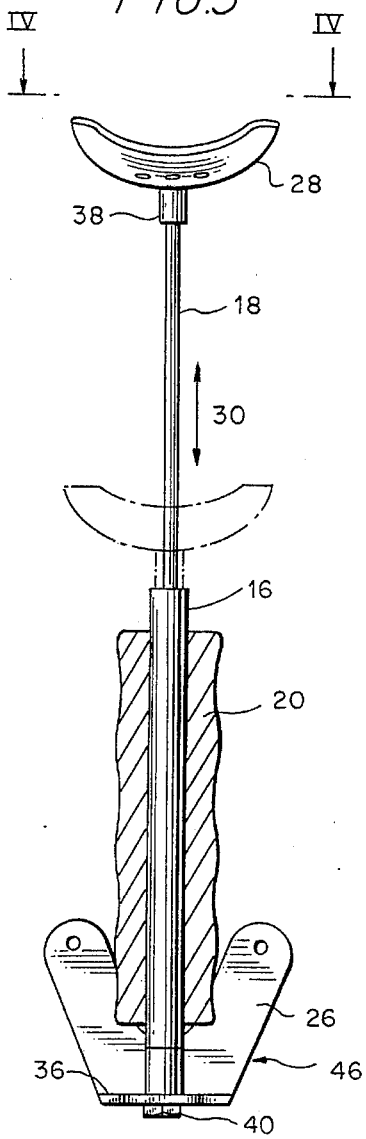
FIG. 3 is a front view in partial cross-section of the device after removal of the collar strap.

The chin cup 28 includes a socket 38 connected thereto for receiving the piston rod 18. The socket may be rigid or flexible, e.g., hinged or including a universal or ball joint. FIG. 3 shows a ball-joint socket 38.

Figure 6:
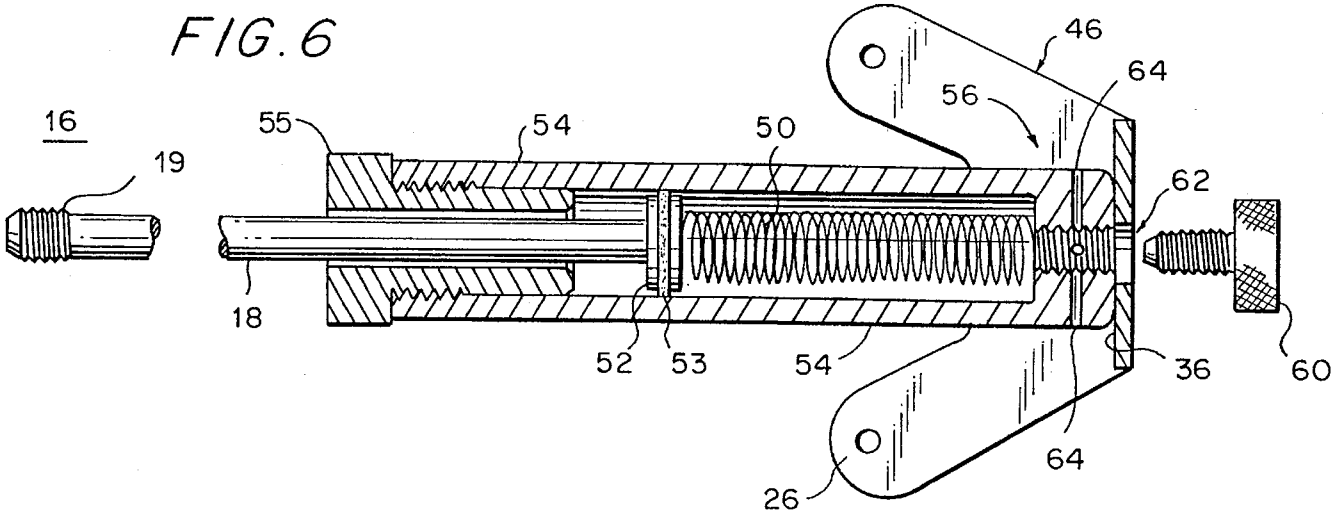
FIG. 6 is a front elevation in partial cross-section of a first embodiment of a spring element which may be used in the present invention.

The spring 16 may be of any desired construction, such as a coil spring type device or a gas spring of well known construction. Preferably, the resistance provided by this spring is adjustable by the user. One such device is shown in FIG. 6, showing the construction of the spring 16. The piston rod 18 includes an end 19 threaded for attachment to the socket 38 of the chin cup 28. The rod 18 is shown in broken view in FIG. 6; its full length is shown in FIGS. 1 and 3. The rod 18 ends in a piston 52 that slides inside the bore of a cylinder 54 (shown in cross section). A gasket, O-ring, or other sealing device 53 is incorporated into the piston 52 to prevent air from leaking between the piston 52 and cylinder 54 bore. A collar 55 (shown in cross section) is removably inserted into the cylinder 54 bore, for example by screw threads. The collar 55 includes a small bore in which the rod 18 sides, which aligns the rod 18 and keeps it coaxial with the cylinder 54. The cylinder 54 terminates in an end piece 56 which, at least in part, may be integrated with the cylinder 54. A coil spring 50 is disposed within the cylinder 54 bore between the piston 52 and the end piece 56.

At the lower end of the cylinder 54 the chest plate 46 is attached to the end piece 56. End piece 56 also includes an air-damping system for the rod 18. The system includes a knurled adjustment screw 60, a threaded bore 62 accepting the screw 60, and four air bleed passageways 64 connecting the bore 62 with the outside of the piece 56. The four air bleed passageways 64 are preferably radially disposed outward from the bore 62.

The spring 16 acts to damp the motion of the rod 18 relative to the chest plate 46. When the user pushes down on the chin cup 28 the rod 18 and piston 52 are forced down the bore of the cylinder 54, compressing the return spring 50 and the air within the cylinder 54. The air may escape through the air bleed passageways 64. The rate of escaper and the degree of damping, are controlled by the position of the adjustment screw 60 in the bore 62; as it is screwed in, the air bleed passageways 64 are covered, blocking the trapped air from escaping easily. Thus, the force required of the user to depress the chin cup 28 depends in part on the position of the adjustment screw 60. The other part is dependent on the compressive resistance of the coil spring 50 and sliding friction. Thus, the adjusting screw 60 serves as a means to adjust the amount of force which is required to depress rod 18. When the user releases the cup 28, the speed of its return to the upper position is damped by the air damping system as adjusted by adjustment screw 60, because air must be sucked back into the cylinder 54 to release vacuum. Otherwise, the piston 52 cannot be pushed upward by the coil spring 50.

The stroke of the piston 52 is preferably three and a half to four inches. In the embodiment of the spring 16 shown in FIG. 6, the stroke is stopped at the upper end by the piston 52 contacting the collar 55, and is stopped at the lower end by closing of the spring 50.

Figure 7:
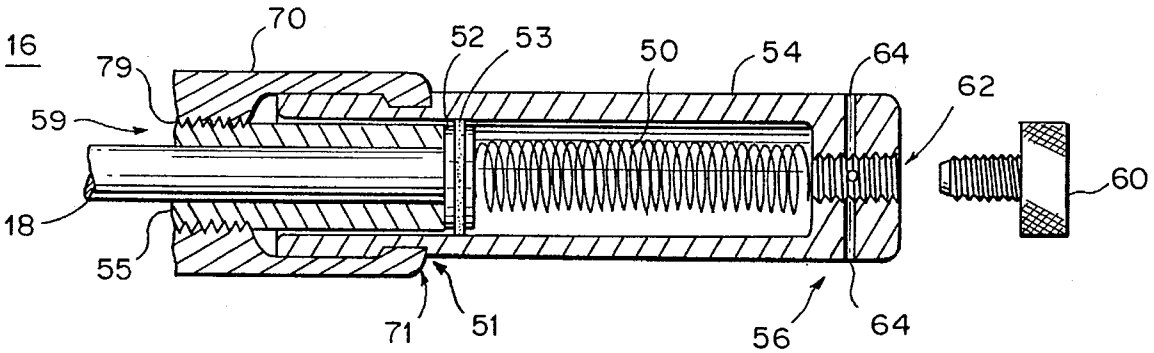
FIG. 7 is a front elevation in partial cross section of a second embodiment of a spring element which may be used in the present invention.

A second embodiment of the spring 16 is depicted in FIG. 7. For ease of illustration, the chest plate 46 is not shown in FIG. 7. In the embodiment of FIG. 7 the compressive resistance of the coil spring 50 is made adjustable.

The various parts of the FIG. 7 embodiment which are the same as those illustrated in the FIG. 6 embodiment have been assigned identical reference numbers. In FIG. 7, spring 16 also includes a sleeve 70 which is fixed in the axial (or longitudinal) direction but is freely rotatable on the cylinder 54. Axial motion is prevented by an internal flange 71 of the sleeve 70 which protrudes into a circumferential groove 51 in the cylinder 54. The collar 55 includes at the extending end external threads 59 that mate with internal threads 79 of the sleeve 70. When the sleeve 70 is rotated the collar 55 is moved axially by the threaded engagement with the axially locked sleeve 70. Thus, rotating the sleeve 70 varies the rest position of the piston 52 with respect to the coil spring 50 and thereby varies the force being exerted by the coil spring 50 against the piston 52 at the rest position. The more force which is applied to the piston 52 by the coil spring, the more force is needed to depress rod 18. Thus, the required amount of force needed to be exerted by the chin to depress the rod 18 of the spring 16 is adjustable not only by turning adjusting screw 60 but also by turning sleeve 70.

The resistance against the movement of the piston rod 18 is provided by the static force of coil spring 50, and/or pneumatic damping in the illustrated embodiment. In alternate embodiments (not shown), the resistance may be achieved by any known means such as non-linear springs, elastomeric materials, viscous liquid or dry friction, etc. Alternative air bleed arrangements may be used, such as, for example, a single needle valve disposed on the side of the cylinder 54. A one-way check valve may be employed to vary the ratio of force on the insertion and return strokes. In general, other designs may be chosen as needed to achieve various desired characteristics of force and damping in the present invention.

As indicated above, the spring 16 is not limited to the coil spring or pneumatic type device shown in FIGS. 6 and 7 but any type of spring may be employed, preferably with the capability of permitting adjustments of the force required to depress the spring. Such springs are well known to those of ordinary skill in the art and are available in the marketplace. Non-limiting examples of such springs are illustrated in U.S. Pat. Nos. 965,836 and 3,041,060. The bottom of the spring device 16 may be connected to the horizontal plate 36 of the chest plate 46 in a manner that it is pivotals either in the plane of the paper in FIG. 10 or with a ball joint so that it may pivot in all directions.

While a solid piston rod 18 is shown in the illustrated embodiment, it should be understood that a sliding cylindrical piston which slides within the fixed cylinder is also intended to be included within the definition of "piston" as used herein. Such an arrangement is shown, for example, in FIG. 4 of U.S. Pat. No. 3,041,060.

In order to prevent the piston 18 from returning to its rest position with such force that it may injure the user, a preferred embodiment of the present invention includes a damper in conjunction with the spring mechanism as is illustrated in FIGS. 6 and 7. Other such dampers are known, for example, on door check devices. In this regard, sees for example, U.S. Pat. Nos. 2,447,678 to Alexander, 2,227,656 to Lindsay, 1,036,340 to Rockwell et al., and 678,790 to Nushawg et al. All of these patents are incorporated herein by reference and those of ordinary skill in the art could readily select an appropriate spring having the preferred functional characteristics.

Figure 8:
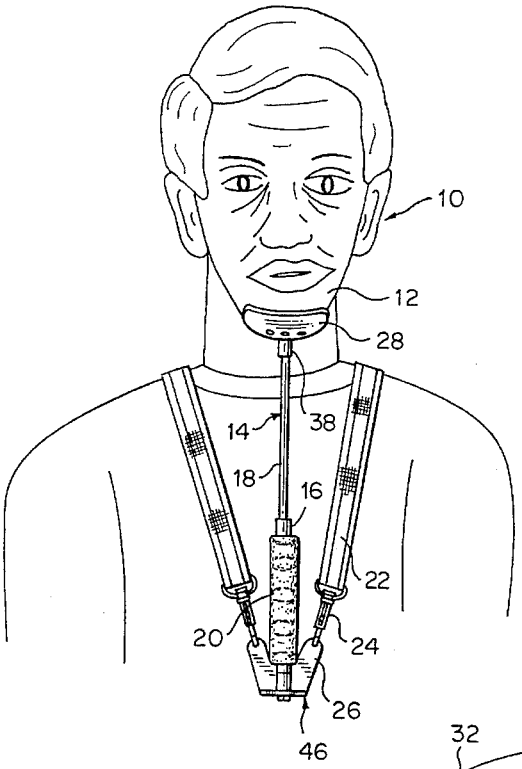
FIG. 8 is a front view of an individual using the device of the present invention with the device at rest.
Figure 9:
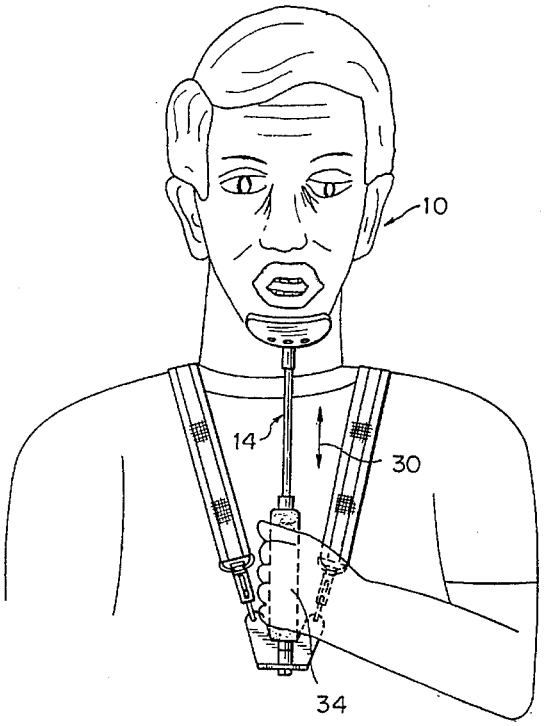
FIG. 9 is a front view of an individual using the device of the present invention with the jaw opened against the resistance of the device.
Figure 10:
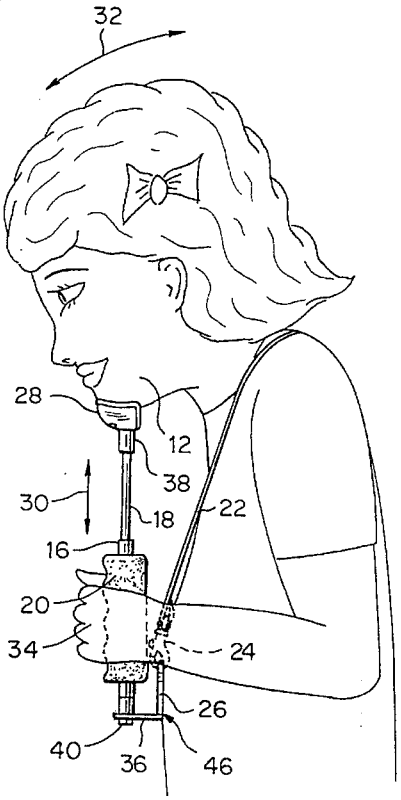
FIG. 10 is a side view of an individual using the device of the present invention showing the exercise of the neck muscles by moving the entire head against the resistance of the device.

FIGS. 8–10 show how the device of the present invention is preferably used. The user 10 places the collar strap 22 around his/her neck and connects the clips 24 to the chest plate 26. The length of the strap 22 is set to a comfortable distance by means of the buckle 42. The length of the collar strap 22 should be set so that the chin 12 of the user can rest in the chin plate 28 of the device of the present invention with the head in a comfortable upright position while the piston rod 18 is at its fully extended position. This rest position is shown in FIG. 8.

FIG. 9 shows the next step in which the user 10 forces his/her jaw into an open position while holding the handle 20 to insure that the chin plate 28 does not slip off the chin 12 when in use. Opening of the jaw such as is shown in FIG. 9 causes the piston rod 18 to move downwardly against the resistance of the spring 16. When the jaw is closed, the piston is forced back to its original position by the spring 16, the piston thus moving up and down in the direction of the arrows 30.

FIG. 10 shows an alternate exercise in which different muscles may be toned. The user positions the device in the same way at the beginning as is shown in FIG. 8. However, rather than opening and closing the jaw, the user leaves his/her mouth closed and moves the entire head back and forth in the direction shown by arrows 32. This also forces the piston to move up and down in the direction of the arrows 30. The exercise shown in FIG. 10 exercises the neck muscles while that shown in FIG. 9 exercises the jaw muscles.

Once the muscles have begun to develop some tone after a number of days of exercise, the spring may be adjusted to increase the resistance, thereby requiring more force on the part of the jaw muscles or neck muscles to force the piston 18 downward. The resistance may also be adjusted to account for the physical condition of the user. The resistance is adjusted by turning the adjustment screw 60 of the embodiment of FIG. 6 or one or both of the adjustment screw 60 and sleeve 70 in the embodiment of FIG. 7.

The device of the present invention provides an excellent way of working the digastric muscle in order to tax it and make it work and expend energy. The compressive resistance cylinder on the device creates the upward resistance and it has an adjusting mechanism to increase and decrease the resistance within a certain range of forces. This adjustability is a very important preferred feature of the present invention because as soon as a user starts to perform the exercises and do them regularly, the muscles will quickly become stronger in this area very similarly to a body builder who lifts weights and becomes strong in the various "pressing" and "curling" exercises he performs. His muscles become hardened, conditioned, and grow stronger in response to the exercise thus requiring that the body builder use heavier weights as his muscles become toned.

Tightening the digastric, hyoid and infrahyoid muscles through exercise using the device of the present invention will greatly improve the appearance of this part of the face. This is immensely preferable to having a surgical face lift where the facial skin is cut and tightened. The device of the present invention permits the types of exercises which have been found to alleviate TMJ problems in a manner which is much better than merely using one's fingers and thumbs.

Because the chest plate 46 may pivot around the clips 24, the axis of the piston 18-spring 16 may rotate somewhat toward and away from the body or from the right to the left, if desired, without changing the position of the chin 12 in the chin cup 28. Thus, the sliding and rubbing of the chin along a flat chin plate as is shown in U.S. Pat. No. 3,497,217 is avoided. There is also much more flexibility in the device of the present invention as a fixed hinge point 13, such as in the Feather patent, is eliminated.

The spring 16 of the present invention may be combined with the device of the present inventor disclosed in co-pending application Ser. No. 08/104,893, the entire contents of which are hereby incorporated herein by reference. In such an embodiment the piston 18 would be connected not only to the chin cup 28 but also to a mouthpiece such as shown in said copending application which overhangs the lower jaw of the user. The spring 16 illustrated in FIGS. 6 and 7 provides resistance in both directions. Thus, resistance must be overcome to force the piston 18 downwardly as well as to pull it upwardly. The force of the chin 12 and the chin cup 28 would force the piston 18 downwardly against the resistance of the spring 16. In order to close the jaw, the mouthpiece which overhangs the lower jaw would have to be forced upwardly against the resistive force of the air damping system of the spring 16, thus providing the benefits of both devices simultaneously.

The foregoing description of the specific embodiments will so fully reveal the general nature of the invention that others can, by applying knowledge within the skill of the art (including the contents of the references cited herein), readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one of ordinary skill in the art.

What is claimed is:

1. A portable jaw and neck muscle exercise apparatus, comprising:

a piston;

a cylinder positioned substantially coaxially with said piston, one end of said piston extending into one end of said cylinder;

spring means within said cylinder for providing resistance against the movement of said piston into said cylinder;

a chin cup connected to one end of said piston and cylinder combination; and anchor means for holding said piston and cylinder combination in place between the chin and chest of the user when in use.

2. An exercise apparatus in accordance with claim 1, wherein said anchor means includes:

a collar strap; and a chest plate connected to said collar strap, wherein the end of said piston and cylinder combination opposite the end on which said chin cup is disposed is connected to said chest plate.

3. An exercise apparatus in accordance with claim 1, wherein said spring means is adjustable in order to vary said resistance against the movement of said piston rod into said cylinder.

4. An exercise apparatus in accordance with claim 2, wherein said spring means is adjustable in order to vary said resistance against the movement of said piston rod into said cylinder.

5. An exercise apparatus in accordance with claim 1, wherein the portion of said chin cup which comes into contact with the chin of the user when in use is padded.

6. An exercise apparatus in accordance with claim 1, further including grip means connected to the exterior of said cylinder for facilitating grasping of the cylinder by the user.

7. An exercise apparatus in accordance with claim 2, further including adjusting means connected to said collar strap for adjusting the length of said collar strap.

* * * * *